United States Patent [19]

Stahlecker

[11] Patent Number: 4,704,860

[45] Date of Patent: Nov. 10, 1987

[54] FIBER FEED ARRANGEMENT FOR OPEN-END FRICTION SPINNING MACHINES

[75] Inventor: Fritz Stahlecker, Josef-Neidhart-Strasse 18, 7347 Bad Uberkingen, Fed. Rep. of Germany

[73] Assignees: Fritz Stahlecker; Hans Stahlecker, both of Fed. Rep. of Germany

[21] Appl. No.: 909,944

[22] Filed: Sep. 22, 1986

[30] Foreign Application Priority Data

Sep. 21, 1985 [DE] Fed. Rep. of Germany ..... 3533718

[51] Int. Cl.[4] ..... D01H 1/135; D01H 7/898

[52] U.S. Cl. ..... 57/401; 57/408; 57/413

[58] Field of Search ..... 57/400, 401, 406, 407, 57/412

[56] References Cited

U.S. PATENT DOCUMENTS

| | | | |
|---|---|---|---|
| 3,927,516 | 12/1975 | Stahlecker | 57/407 |
| 4,109,451 | 8/1978 | Yamada et al. | 57/407 X |
| 4,514,974 | 5/1985 | Stahlecker | 57/401 |
| 4,539,807 | 9/1985 | Stahlecker | 57/401 |
| 4,567,722 | 2/1986 | Stahlecker | 57/401 |
| 4,638,626 | 3/1987 | Stahlecker et al. | 57/401 |

FOREIGN PATENT DOCUMENTS

| | | |
|---|---|---|
| 0098380 | 1/1982 | European Pat. Off. . |
| 2800795 | 8/1979 | Fed. Rep. of Germany . |

*Primary Examiner*—Donald Watkins

*Attorney, Agent, or Firm*—Barnes & Thornburg

[57] ABSTRACT

An arrangement for open-end friction spinning is provided having a one-piece component fiber feeding duct that is mounted at an opening roller housing. The opening roller housing is held in a stationary position by a holding means containing a snap closure and the opening roller housing together with the fiber feeding duct can be removed for the exposure of the yarn-forming zone.

18 Claims, 3 Drawing Figures

FIBER FEED ARRANGEMENT FOR OPEN-END FRICTION SPINNING MACHINES

BACKGROUND AND SUMMARY OF THE INVENTION

This invention relates to a fiber feeding arrangement for open-end friction spinning. Preferred embodiments usable with the invention have at least one friction roller forming a yarn-forming zone and a feeding and opening device that contains an opening roller arranged in an opening roller housing. A fiber-feeding duct starts at the opening roller and extends to the at least one friction roller to a mouth disposed opposite the yarn-forming zone.

In the case of an arrangement of this type disclosed in German Unexamined Published Application (DE-OS) No. 3,300,637 the fiber feeding duct is formed in two parts. The first part of the fiber feeding duct is a component of an opening roller housing. The second part of the fiber feeding duct is a component of a covering that can be moved away for exposing the friction rollers and the wedge-shaped gap formed by them. By means of this type of construction good accessibility to the yarn-forming zone is possible for servicing, however, in this arrangement a parting line in the fiber feeding duct has to be accepted. It has been determined that such a parting line may impair the spinning results. Presumably, the reason for such impairment relates to the parting line influencing the air flows that significantly determine the friction effect and flow to the yarn-forming zone.

In the case of the diagrammatically represented arrangement for open-end friction spinning disclosed in German Published Unexamined Application (DE-OS) No. 2,714,089, it is also shown to develop a fiber feeding duct in one piece with an opening roller housing. It is not shown in this document how the area of the friction rollers and of the yarn-forming zone can be exposed for servicing.

An arrangement in also disclosed European Unexamined Published Application (EP-OS) No. 52,412 with a fiber feeding duct arranged stationarily at a machine part. For the exposing of the yarn-forming zone, one of the two friction rollers that forms a wedge-shaped gap as the yarn-forming zone is arranged pivotably.

This invention is based on the objective of providing an arrangement of the initially mentioned type wherein, on the one hand, a parting line in the fiber feeding duct is avoided, while, on the other hand, the at least one friction roller and the yarn-forming zone can be readily exposed for servicing.

The objective is achieved according to the invention by providing that the fiber feeding duct is a one-piece component that is mounted at the opening roller housing which, by means of a holding device, is held in a stationary position, the holding device containing a securing device permitting a quick removal of the opening roller housing.

By means of this arrangement, any parting line in the area of the fiber feeding duct is avoided, while, nevertheless, the at least one friction roller and the yarn-forming zone, can be exposed in a simple way by the removal of the opening roller housing together with the fiber feeding duct.

In order to provide a simple and secure holding means for the opening roller housing, it is provided according to a further development of preferred embodiments of the invention that the opening roller housing is fitted with a guide means onto a shank that extends substantially perpendicularly to the yarn-forming zone and is stationarily mounted at the machine frame, and is held by a securing means aligned in circumferential direction to the shank. In the case of this embodiment, the opening roller housing can be removed in a simple way and installed by the pulling-off and refitting the same onto the shank. In a further development, it is provided that in the operating position, the opening roller housing is held with a stop face at an axial stop of the shank. Thus the position of the opening roller, and especially also the position of the fiber feeding duct, with respect to the yarn-forming zone is determined precisely. In an advantageous further development of such embodiments, it is provided that in the operating position, the opening roller housing is pressed against the stop of the shank with an elastic element that is mounted at a covering that can be moved away from the opening of the arrangement. In this way, a quick closure is provided that does not require any separate actuating because the covering already largely takes over the function of the quick secure closure.

In a further development of preferred embodiments of the invention, it is provided that the fiber feeding duct is fitted into a recess of the opening roller housing, a support being provided that defines the fitted-in position. As a result, it is possible to arrange the fiber feeding duct detachably in the opening roller housing so that it can be exchanged and replaced when required. In certain circumstances, it is also contemplated in this case to exchange the fiber duct for the adaptation to special spinning conditions, with one that has a more suitable shape for these spinning conditions.

In a further development of a preferred embodiments of the invention, it is provided that the fiber feeding duct is formed from a flat piece of pipe that has an essentially oval cross-section that tapers away from the opening roller, the piece of pipe being arranged tangentially to the circumference of the opening roller, its larger cross-sectional length corresponding at least to the width of a set of opening roller means. The duct is equipped with a mouth extending in a slot-shaped manner in the direction of the yarn-forming zone and diagonally to the longitudinal axis of the piece of pipe. Such a fiber feeding duct may be formed to be very flat so that it can be moved very closely to the yarn-forming zone, even though this zone is formed by a wedge-shaped gap between two friction rollers.

Further objects, features, and advantages of the present invention will become more apparent from the following description when taken with the accompanying drawings which show, for purposes of illustration only, an embodiment in accordance with the present invention.

DETAILED DESCRIPTION OF THE DRAWINGS

Figure 1:
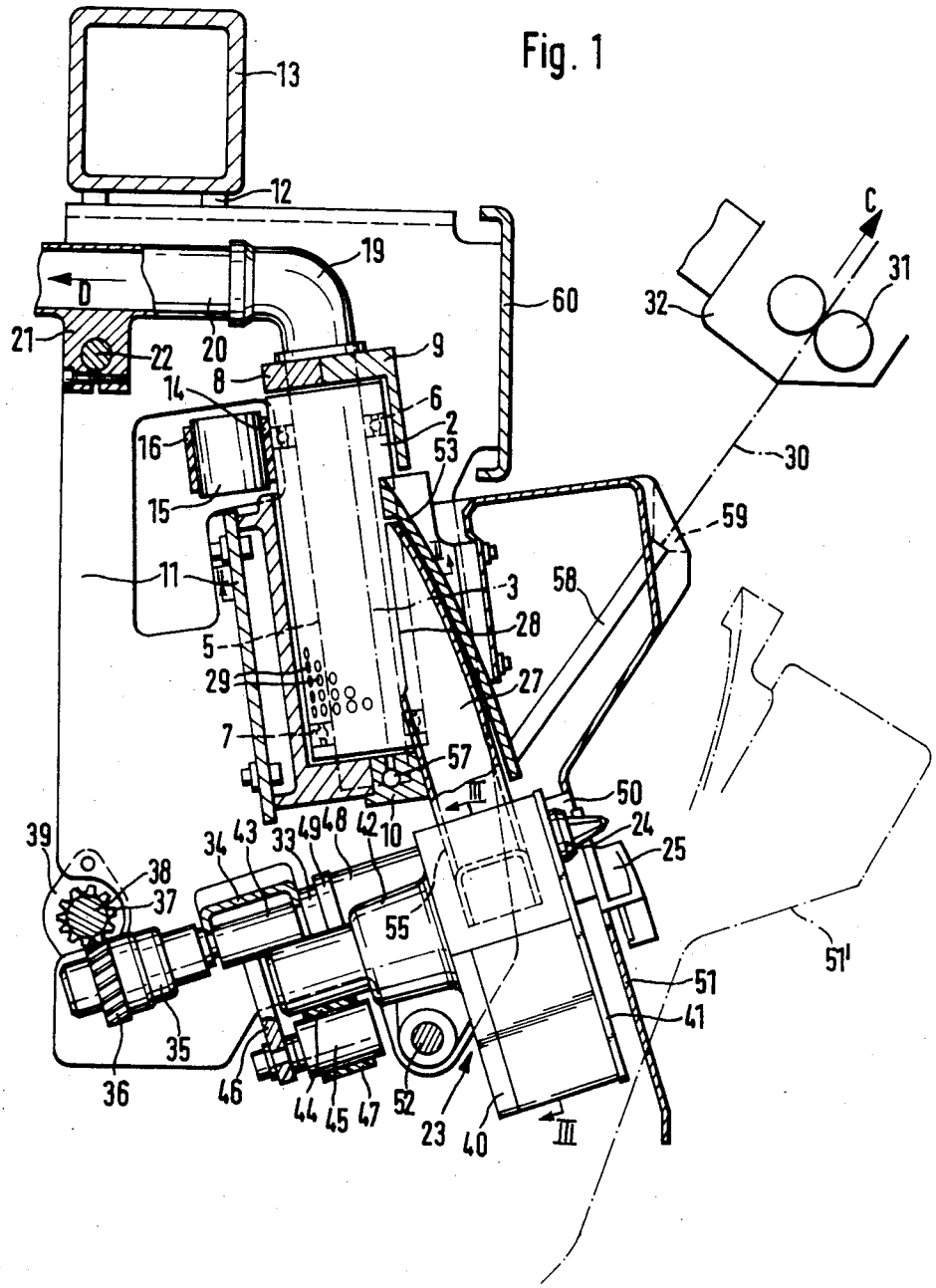
FIG. 1 is a partial schematic sectional view through an arrangement for open-end friction spinning constructed according to a preferred embodiment of the invention.

The illustrated arrangement for open-end friction spinning contains two cylindrical friction rollers 1 and 2 that are arranged next to one another and in parallel to one another to form a wedge-shaped gap 3 serving as the yarn-forming zone. Both friction rollers 1 and 2 are formed as suction rollers. In their interiors, respective pipes 4 and 5 are arranged on which the shells of the friction rollers 1 and 2 are disposed with roller bearings 6 and 7. The pipes 4 and 5 are clamped into a roller carrier 8 that has a U-shaped cross-section and surrounds the friction rollers 1 and 2 up to the operating side that is assigned to the fiber-feeding wedge-shaped gap 3. The roller carrier 8 by means of screws is fastened at a carrying body 11 of the machine frame. The carrying body 11 itself is fastened via separators at a rectangular pipe frame 13 extending in the longitudinal direction of the machine. In practical embodiments, a plurality of such spinning units would be arranged adjacent one another and carry the pipe frame 13.

Figure 2:
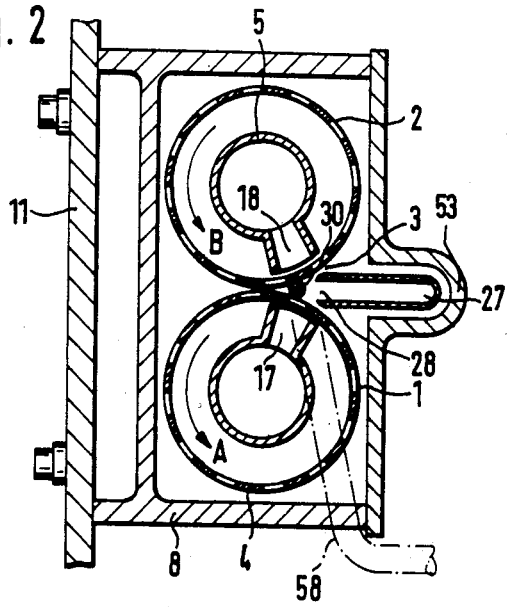
FIG. 2 is a sectional schematic view taken along line II—II of FIG. 1.

The friction rollers 1 and 2 are driven via a tangential belt 14 in the same rotational direction in the direction of the Arrows A and B (FIG. 2). The friction roller 1 rotates into the wedge-shaped gap 3, while the friction roller 2 rotates out of this gap. In the operating condition, the tangential belt 14 is pressed by means of a tension roller 15 against the shell surfaces of the friction rollers 1 and 2 at a position facing away from the wedge-shaped gap 3. On the tension roller 15, the returning side 16 of the tangential belt 14 is also guided.

The pipes 4 and 5 have respective suction slots 17 and 18 directed toward the area of the wedge-shaped gap 3. At one end face, the pipes 4 and 5 are closed, while with the opposite end faces projecting out of the friction rollers 1 and 2 are connected to a suction pipe 20 via a bend 19. The suction pipe 20 is connected to a vacuum source that is not shown, through which a suction air flow is generated in the direction of the Arrow D. The suction pipe 20 is fastened via a holding means 21 at a crosspiece 22 that itself is held at the carrier 11. The shell surfaces of the friction rollers 1 and 2 are perforated so that in the area of the fiber-carrying wedge-shaped gap 3, air currents are generated that enter the suction slots 17 and 18 through the shell surfaces of the friction rollers 1 and 2.

Below the approximately vertically arranged friction rollers 1 and 2 that are inclined slightly toward the rear of the arrangement, a feeding and opening device 23 is arranged that projects beyond the friction rollers 1 and 2 in the direction of the operating side. By means of this feeding and opening device 23, individual fibers are fed to the wedge-shaped gap 3 that are disengaged from a fed sliver. The feeding and opening device 23 contains a feeding roller 24 to which a sliver to be spun is fed via a feeding funnel 25. The feeding roller 24, in the customary way, interacts with a feeding table that is not shown and offers the sliver to a significantly faster rotating opening roller 26 that is equipped with a set of saw teeth or needles or similar means that are only outlined in FIG. 3. The opening roller 26 combs out the sliver and disengages the individual fibers from the fiber material which are fed to the area of the wedge-shaped gap 3 via a fiber feeding duct 27. The individual fibers reach the wedge-shaped gap 3 in an air current generated in the fiber feeding duct 27. This air current is generated essentially by the air flow sucked in via the suction slots 17 and 18 through the shells of the friction rollers 1 and 2.

In the wedge-shaped gap 3, the fed fibers are twisted together into a yarn 30 that is also held by the generated air currents in the wedge-shaped gap 3. The forming yarn 30, in longitudinal direction of the wedge-shaped gap 3 is withdrawn in downward direction against the feeding direction of the fibers. The withdrawn yarn is, for example, within a withdrawal duct 58, deflected diagonally upwards and is withdrawn by a pair of withdrawal rollers 31 that are held at a carrier 32. The yarn 30 will then move on in the directon of the arrow C to a wind-up device that is not shown.

The feeding roller 24 is disposed in a pipe 33 that, by means of a holder 34, is held at the carrier 11. The shank of the feeding roller 24 that projects out of the pipe 33 is driven via a shaft 38 that is equipped with a toothed wheel 37 that mates with a toothed wheel 36. The toothed wheel 36 is connected with the shank of the feeding roller 24 via an electromagnetic coupling 35. In the case of the breakage, the feeding roller 24 can be stopped by an opening of the coupling 35 without having to interrupt the drive of the shaft 38. The shaft 38 is held at the carrier 11 by means of a bearing holder 39.

The opening roller 26 is surrounded by an opening roller housing 40 that is equipped with a cover 41 on the front side facing the operating side. The opening roller 26, with a shank 43, is disposed in a bearing projection 42 of the opening roller housing 40 arranged on the rear side. The shank 43 projects from this bearing projection 42 toward the rear and is driven by a tangential belt 44. The tangential belt 44 is loaded by a tension roller 45 in the direction of the shank 43, the returning end 47 of the tangential belt 44 being guided on the tension roller 45. The tension roller 45 is fastened at a holder 46 that itself is mounted at the carrier 11.

Figure 3:
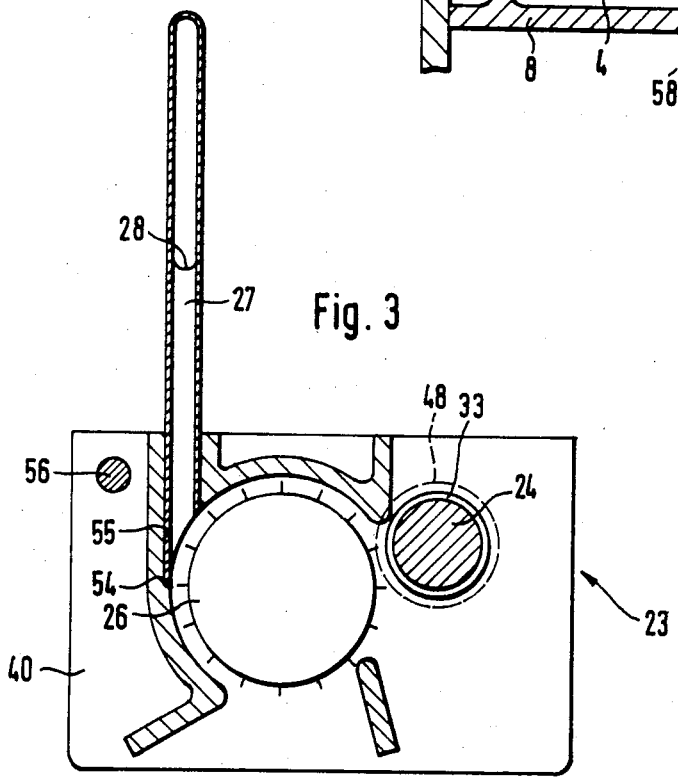
FIG. 3 is a sectional schematic view taken along line III—III of FIG. 1.

The rear side of the opening roller housing 40 is also equipped with a sleeve-type guide means 48, by means of which the opening roller housing 40 is fitted onto the pipe 33 that surrounds the feeding roller 24. As shown in FIG. 3, the rear wall of the opening roller housing 40 extends over the area of the feeding roller 24, while the walls surrounding the opening roller 26 that contain an elmination opening are limited essentially to the area of the opening roller 26. The cover 41 also extends only over this area. In addition, the rear wall of the opening roller housing 40 is provided with an opening into which is fitted a bolt 56 which is parallel to the feeding roller 24. The feeding roller 24 is in a position defined in circumferential direction of the pipe 33.

In the shown operating position, the outer edge of the guide device 48 rests against a collar 49 of the pipe 33 so that the position of the opening roller housing 40 is defined in axial direction to the pipe 33. In this position, the opening roller housing 40 is held by an elastic thrust piece 50 that rests against the opening roller housing 40 or preferably its cover 41. The elastic thrust piece 50 is mounted at a covering 51 that can be swivelled around a shaft 52 extending transversely to the pipe 33 and thus also to the shank 43 of the opening roller 26. The covering 51 that is made of sheet metal or plastic extends over the area of the opening roller housing 40 and the area of the two friction rollers 1 and 2 located above it as well as the fiber feeding duct 27. The covering 51 that is locked in the operating position, in a way that is not shown in detail, carries the yarn-withdrawal duct 58 and forms a feeding funnel 59 for the duct. In addition, the covering 51 carries a cover 53 that is placed against the edges of the roller housing 8 in a sealing manner. This cover 53 has a bulging area with which the fiber feeding duct 27 is surrounded without contact in the operating position. The upper area of the friction rollers 1 and 2, as well as the area in which the bend 19 is located, is covered by a stationary casing 60. The covering 51 can be swivelled into the dash-dotted position that so that the opening roller housing 40 and the largest area of the friction rollers 1 and 2 are exposed for servicing purposes. If it becomes necessary in a further servicing step to completely expose the wedge-shaped gap 3, the opening roller housing 40 and the fiber feeding duct 27 attached thereto are then removed in a simple manner from the pipe 33 and the bolt 56.

As is shown especially in FIGS. 1 and 3, the fiber feeding duct 27 is set into a recess 55 of the opening roller housing 40 whereby the inserted position is define by means of a shoulder 54 of the opening roller housing 40 which serves as a stop. The feeding duct 27 set into the opening roller housing 40 immediately connects to the opening roller 26 in tangential direction.

The fiber feeding duct 27 exhibits a flat, oval cross-section. The larger cross-sectional length extends in axial direction of the opening roller 26. The cross-sectional length is thereby chosen such that its size corresponds to the working width of the opening roller 26. This width is the area where the opening rollers 26 is provided with a fitting. The fiber feeding duct 27 extending in a straight line in tangential direction of the opening roller 26 slightly decreases in cross-section up to the area of the mouth 28.

As shown in FIG. 1, the plane of the rotating shafts of the friction rollers 1 and 2 extends approximately at a right angle to the shank 43 of the opening roller 26. The angle is about 80° to 85°. The mouth 28 of the fiber feeding duct 27 extends in a slot-shaped manner essentially in parallel to the wedge-shaped gap 3 and extends diagonally to the longitudinal axis of the fiber feeding duct 27. As shown in FIG. 1, the lateral wall of the fiber feeding duct 27 facing away from the wedge-shaped gap 3 is slightly bent in order to bring the most extreme end of the fiber feeding duct 27 close to the wedge-shaped gap 3.

The fiber feeding duct 27 is developed to be as flat as possible in order to project as deeply as possible into the wedge-shaped gap 3 and is developed as a flat piece of Pipe that is exchangeably fitted into the recess 55 of the opening roller housing 40.

In the case of the first embodiment, the pipe piece 27 forming the fiber feeding duct is made from a pipe that is cylindrical at one end. This cylindrical pipe is first slightly conically expanded so that the cross-section of the fiber feeding duct 27 tapers correspondingly from the entry end in the area of the opening roller 26 toward the mouth 28. Subsequently, this conically expanded pipe piece is flattened into the shape shown in FIGS. 1 to 3 so that the fiber feeding duct 27 receives the flat-oval cross-section. As the next step, the side wall of the pipe piece that faces away from the wedge-shaped gap 3 in the installed condition is slightly widened by the introduction of a corresponding expanding tool and by a supporting machining that, if necessary, may take place from the outside, so that the arched shape is obtained that is shown in FIG. 1. Subsequently, the ends of the pipe piece are machined in order to obtain the inlet on the one side that is adapted to the circumference of the opening roller 26 and obtain the mouth 28.

In the case of another embodiment, the fiber feeding duct 27 in the form that is shown in FIGS. 1 to 3 is manufactured as an injection-molded part, especially an aluminum die-cast part.

In the case of another embodiment, it is provided that a core is first manufactured that has the interior shape of the fiber feeding duct 27. Around this core, a pipe piece is then made by means of an arc metal spray process. Such an arc metal spray process and suitable devices for this purpose can be obtained, for example, from the firm HEK GmbH 4200 Lübeck.

All the present invention has been described and illustrated in detail, it is to be clearly understood that the same is by way of illustration and example only, and is not to be taken by way limitation. The spirit and scope of the present invention area to be limited only by the terms of the appended claims.

I claim:

1. Arrangement for open-end friction spinning including:

at least one friction roller creating a yarn-forming zone, an opening device housing;

an opening device arranged in the opening device housing;

a fiber feeding duct extending from the opening device to the at least one friction roller opposite the yarn-forming zone, said fiber feeding duct being a one-piece component, said fiber feeding duct being unitarily mounted at the opening device housing; and holding means for holding the fiber feeding duct in a stationary position, said holding means including a securing means for permitting quick removal of the opening device housing.

2. Arrangement as in claim 1 including a shank extending essentially perpendicularly to the yarn forming zone and mounted stationarily at the machine frame; guide means on said opening device housing for fitting the opening device housing onto the shank; and securing means for securing the opening device housing aligned in circumferential direction to the shank.

3. Arrangement as in claim 2, including an axial stop of the shank and a stop face of the opening device housing, said arrangement having an operating position wherein the opening device stop face is held at the axial stop of the shank.

4. Arrangement as in claim 3, including a covering having an elastic means for pressing the opening device housing up against the stop of the shank in the operating position, said covering being movable to an opening position of the arrangement.

5. Arrangement according to claim 4, including a recess in the opening device housing for receiving the fiber feeding duct, and support means for defining an inserted position of the fiber feeding duct.

6. Arrangement according to claim 5, wherein the opening device includes an opening roller and wherein the fiber feeding duct includes a flat pipe essentially oval and tapering away from the opening roller, said pipe being arranged tangentially to the circumference of the opening roller, said pipe having a larger cross-section end corresponding to at least the approximate width of the opening roller, and another end including a mouth extending in a slot-shaped manner in the direction of the yarn-forming zone and diagonally to the longitudinal axis of the pipe.

7. Arrangement as in claim 6, wherein the pipe of the fiber feeding duct includes a plastically deformed round pipe.

8. Arrangement as in claim 6, wherein the pipe of the fiber feeding duct includes an injection-molded pipe.

9. Arrangement as in claim 6, wherein the pipe of the fiber feeding duct includes an arc metal sprayed pipe having a core area corresponding to an interior shape of the fiber feeding duct.

10. Arrangement as in claim 1, wherein the fiber feeding duct is exchangeably and unitarily mounted at the opening device housing.

11. Arrangement for open-end friction spinning including:

at least one friction roller creating a yarn-forming zone, an opening device housing;

an opening device arranged in the opening device housing;

a fiber feeding duct extending from the opening device to the at least one friction roller opposite the yarn-forming zone, said fiber feeding duct being a one-piece component mounted at the opening device housing;

holding means for holding the fiber feeding duct in a stationary position, said holding means including a securing means for permitting quick removal of the opening device housing;

a shank extending essentially perpendicularly to the yarn forming zone and mounted stationarily at the machine frame; and guide means on said opening device housing for fitting the opening device housing on the shank, said securing means securing the opening device housing aligned in circumferential direction to the shank.

12. Arrangement as in claim 11, including an axial stop of the shank and a stop face of the opening device housing, said arrangement having an operating position wherein the opening device stop face is held at the axial stop of the shank.

13. Arrangement as in claim 12, including a covering having an elastic means for pressing the opening device housing up against the stop of the shank in the operating position, said covering being movable to an opening position of the arrangement.

14. Arrangement according to claim 13, including a recess in the opening device housing for receiving the fiber feeding duct, and support means for defining an inserted position of the fiber feeding duct.

15. Arrangement according to claim 14, wherein the opening device includes an opening roller and wherein the fiber feeding duct includes a flat pipe essentially oval and tapering away from the opening roller, said pipe being arranged tangentially to the circumference of the opening roller, said pipe having a larger cross-section end corresponding to at least the approximate width of the opening roller, and another end including a mouth extending in a slot-shaped manner in the direction of the yarn-forming zone and diagonally to the longitudinal axis of the pipe.

16. Arrangement as in claim 15, wherein the pipe of the fiber feeding duct includes a plastically deformed round pipe.

17. Arrangement as in claim 15, wherein the pipe of the fiber feeding duct includes an injection-molded pipe.

18. Arrangement as in claim 15, wherein the pipe of the fiber feeding duct includes an arc metal sprayed pipe having a core area corresponding to an interior shape of the fiber feeding duct.

* * * * *